US009554202B1

(12) United States Patent
Patsis et al.

(10) Patent No.: US 9,554,202 B1
(45) Date of Patent: Jan. 24, 2017

(54) SPEAKER MOUNTING ASSEMBLY

(71) Applicant: Speaqua Corp., Deer Park, NY (US)

(72) Inventors: Steven G. Patsis, Deer Park, NY (US); Steven Patsis, Deer Park, NY (US)

(73) Assignee: SPEAQUA CORP., Deer Park, NY (US)

( * ) Notice: Subject to any disclaimer, the term of this patent is extended or adjusted under 35 U.S.C. 154(b) by 0 days.

(21) Appl. No.: 14/925,415

(22) Filed: Oct. 28, 2015

(51) Int. Cl.
*H04R 1/02* (2006.01)

(52) U.S. Cl.
CPC ..... *H04R 1/026* (2013.01); *H04R 2201/021* (2013.01); *H04R 2420/07* (2013.01)

(58) Field of Classification Search
CPC ..... H04R 2420/07; H04R 1/026; H04R 2201/021
See application file for complete search history.

(56) References Cited

U.S. PATENT DOCUMENTS 4,853,966 A 8/1989 Skrzycki
5,143,339 A 9/1992 Ashcraft et al.
5,699,438 A 12/1997 Smith et al.
5,739,481 A 4/1998 Baumhauer, Jr. et al.
6,456,722 B1 9/2002 Davey et al.
6,707,925 B1 3/2004 Breithaupt
7,570,778 B2 8/2009 Wright
8,297,402 B2 10/2012 Stewart et al.
9,004,706 B1 * 4/2015 Banfield ..... F21V 33/0056 362/86
2005/0045171 A1 3/2005 Wright
2005/0263342 A1 12/2005 Peng
2007/0060017 A1 * 3/2007 Klusmeyer ..... A47G 19/2227 446/397
2009/0114554 A1 * 5/2009 Earnest ..... A47G 19/2227 206/217

* cited by examiner

*Primary Examiner* — Muhammad N Edun

(74) *Attorney, Agent, or Firm* — Carter, DeLuca, Farrell & Schmidt, LLP

(57) ABSTRACT

The present disclosure is directed to a speaker mounting assembly which includes a top mount having an opening configured for receiving there through at least a portion of a speaker, a speaker platform for resting the at least the portion of the speaker thereon, and a bottom mount configured for connecting to the top mount with the speaker platform positioned there between.

20 Claims, 3 Drawing Sheets

SPEAKER MOUNTING ASSEMBLY

BACKGROUND

Technical Field

The present disclosure is directed to the field of compact audio speakers. More specifically, the present disclosure is directed to a speaker mounting assembly for supporting a speaker and capable of being mounted to a surface.

Related Art

Smartphones and portable speakers enable individuals to listen to music and radio programs in many places. For example, in the shower, on a boat, at the office, outdoors, and during travel. The portable speaker typically communicates with the smartphone or other electronic device via a communication protocol, such as BLUETOOTH®. It is often desirable to mount the portable speaker on a surface for better acoustics, such as, for example, on a wall or mast of a sailboat. Therefore, there is a need for a speaker mounting assembly that can securely support a speaker and be capable of being attached or mounted to any surface.

SUMMARY

This description may use the phrases "in an embodiment," "in embodiments," "in some embodiments," or "in other embodiments," which may each refer to one or more of the same or different embodiments in accordance with the present disclosure. As shown in the drawings and described throughout the following description, the term "bottom" refers to the end of the speaker mounting assembly that is closest to the surface of which it is attached and the term "top" refers to the end of the speaker mounting assembly that includes an opening for a speaker.

In one aspect of the present disclosure, a speaker mounting assembly is provided which includes a top mount having an opening configured for receiving there through at least a portion of a speaker, a speaker platform for resting the at least the portion of the speaker thereon, and a bottom mount configured for connecting to the top mount with the speaker platform positioned there between.

In embodiments, the bottom mount has a wall extending from a base, where the wall includes a plurality of threads on an outer surface thereof. The top mount has a wall extending from a top surface, where the wall includes a plurality of threads on an inner surface thereof. The walls of both the top and bottom mounts are circular, with the wall of the top mount having a diameter greater than the diameter of the wall of the bottom mount. The plurality of threads of the wall of the top mount and the plurality of threads of the wall of the bottom mount threadably engage each other for connecting the top mount and the bottom mount.

In embodiments, an outer surface of the wall of the top mount includes a plurality of knurls for assisting in threadably engaging the top mount and the bottom mount.

In embodiments, the wall of the top mount includes a first wall having a first diameter and a second wall having a second diameter, wherein the second diameter is greater than the first diameter. In embodiments, the base of the bottom mount has a diameter less than the diameter of the second diameter of the second wall of the top mount, such that when the top mount and bottom mount are connected, the base of the bottom mount is within the second wall of the top mount, and the base of the bottom mount serves as a base of the assembled speaker mounting assembly.

In embodiments, a bottom or outer surface of the base of the bottom mount is provided with an adhesive or adhesive padding/tape for mounting the speaker mounting assembly to a surface, such as a wall.

In embodiments, a central portion of the bottom mount includes a speaker platform support structure for supporting the speaker platform. An inner surface of the wall of the bottom mount includes a lip, on the same plane as a top surface of the speaker platform support structure, for further supporting the speaker platform.

In embodiments, the opening of the top mount has a keyhole shape for receiving a suction cup of a speaker, such as the BARNACLE™ speaker available from Speaqua Corporation, Deer Park, N.Y.

BRIEF DESCRIPTION OF THE DRAWINGS

The above and other aspects, features, and advantages of the present disclosure will become more apparent in light of the following detailed description when taken in conjunction with the accompanying drawings in which.

DETAILED DESCRIPTION

Figure 1:
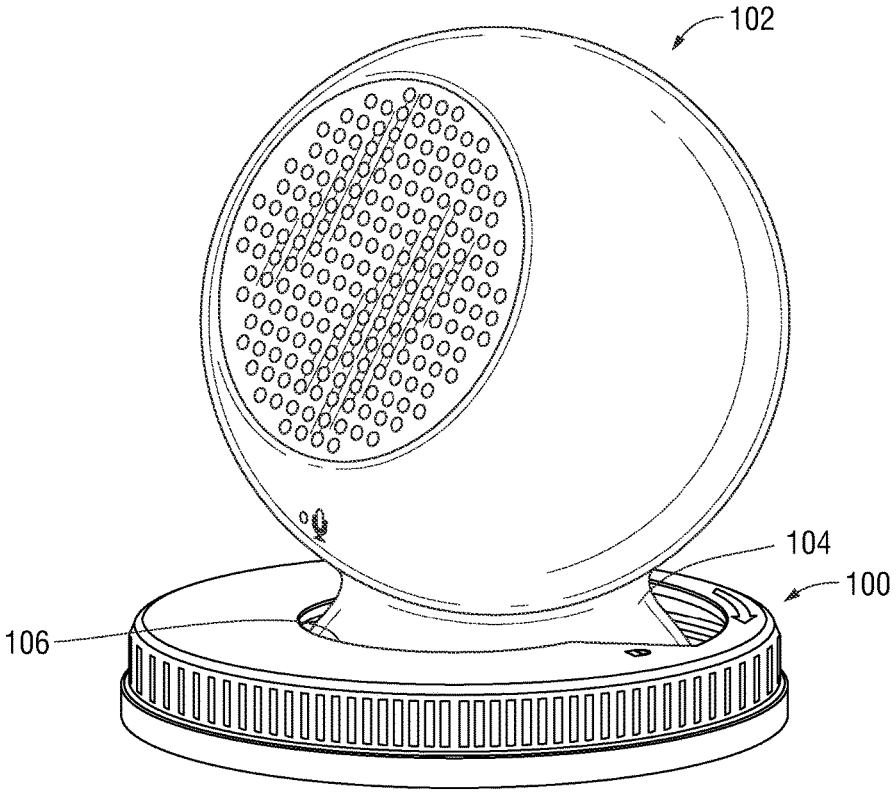
FIG. 1 is a perspective view of a speaker mounting assembly according to an embodiment of the present disclosure with a portion of a speaker therein.

Particular embodiments of the present disclosure are described herein below with reference to the accompanying drawings; however, it is to be understood that the disclosed embodiments are merely examples of the disclosure and may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to variously employ the present disclosure in virtually any appropriately detailed structure. Like reference numerals may refer to similar or identical elements throughout the description of the figures.

With reference to FIG. 1, there is shown a speaker mounting assembly designated generally by reference numeral 100 and having a portion of a speaker 102 therein. The speaker has a suction cup 104 and can be the BARNACLE™ speaker available from Speaqua Corporation, Deer Park, N.Y. The suction cup 104 extends through an opening 106 of the speaker mounting assembly 100. The opening 106 has a keyhole shape. However, other shapes can be used besides the keyhole shape for the opening 106.

Figure 2:
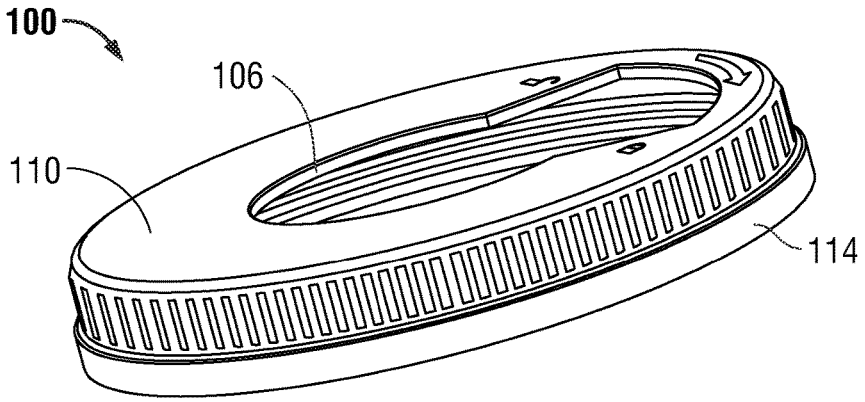
FIG. 2 is a side perspective view of the speaker mounting assembly shown by FIG. 1 without the speaker.

FIG. 2 is a perspective view of the speaker mounting assembly 100 without the speaker 102.

Figure 3:
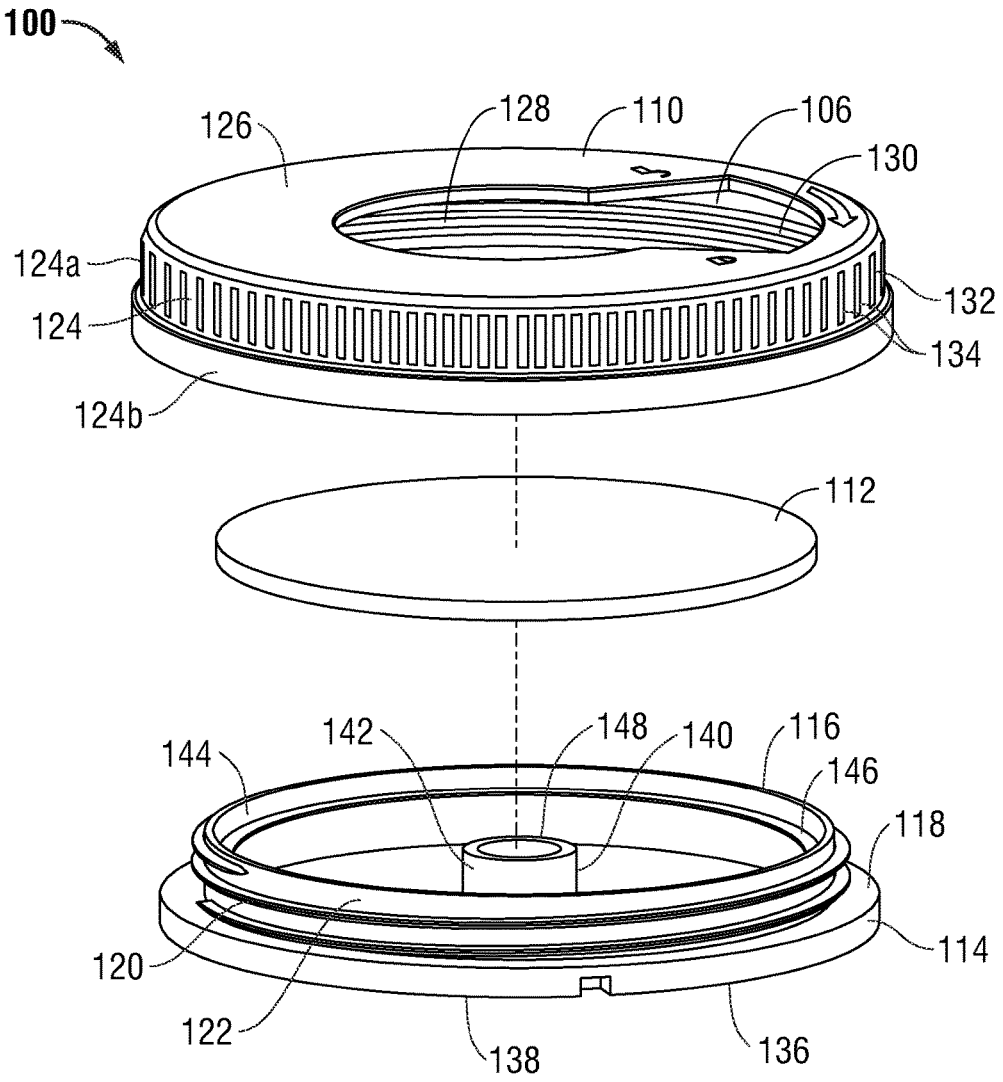
FIG. 3 is an exploded view of the speaker mounting assembly shown by FIG. 1 showing a top mount, a speaker platform, and a bottom mount.

FIG. 3 is an exploded view of the speaker mounting assembly 100. The speaker mounting assembly 100 includes a top mount 110, a speaker platform 112, and a bottom mount 114. The top mount 110 is circular and has the opening 106. The opening 106 is configured for receiving there through a portion of the speaker 102. The portion of the speaker 102 that is provided through the opening 106, in the embodiment shown by FIG. 1, is the suction cup 104. The speaker platform 112 is circular for resting the suction cup 104 thereto. The speaker platform 112 can be made from a material in which the suction cup 104 can easily adhere to, such as acrylic, glass or plastic. The bottom mount 114 is also circular and is configured for connecting to the top mount 110 with the speaker platform 112 positioned there between.

With continued reference to FIG. 3, the bottom mount 114 includes a circular wall 116 extending from a base 118. The wall 116 includes a plurality of threads 120 on an outer surface 122 thereof. The top mount 110 has a wall 124 extending from a top surface 126, where the wall 124 includes a plurality of threads 128 on an inner surface 130 thereof. The walls of both the top and bottom mounts are circular, with the wall 124 of the top mount 110 having a diameter greater than the diameter of the wall of the bottom mount 114. The plurality of threads 128 of the wall 124 of the top mount 110 and the plurality of threads 120 of the wall 116 of the bottom mount 114 threadably engage each other for connecting the top mount 110 and the bottom mount 114.

An outer surface 132 of the wall 124 of the top mount 110 includes a plurality of knurls or grooves 134 for assisting a user threadably engage the top mount 110 and the bottom mount 114.

The wall 124 of the top mount 110 includes a first wall 124*a* having a first diameter and a second wall 124*b* having a second diameter, wherein the second diameter is greater than the first diameter. The base 118 of the bottom mount 114 has a diameter less than the diameter of the second diameter of the second wall 124*b* of the top mount 110, such that when the top mount 110 and bottom mount 114 are connected, the base 118 of the bottom mount 114 is within the second wall 124*b* of the top mount 110, and the base 118 of the bottom mount 114 serves as a base of the assembled speaker mounting assembly 100.

A bottom or outer surface 136 of the base 118 of the bottom mount 114 is provided with an adhesive 138 or adhesive padding/tape for mounting the speaker mounting assembly 100 to a surface, such as a wall.

A central portion 140 of the bottom mount 114 includes a speaker platform support structure 142 for supporting the speaker platform 112. An inner surface 144 of the wall 116 of the bottom mount 114 includes a lip 146, on the same plane as a top surface 148 of the speaker platform support structure 142, for further supporting the speaker platform 112.

The speaker mounting assembly 100 can be part of a speaker mounting assembly kit, where the kit further includes the speaker.

It should be understood that the foregoing description is only illustrative of the present disclosure. Various alternatives and modifications can be devised by those skilled in the art without departing from the disclosure. Accordingly, the present disclosure is intended to embrace all such alternatives, modifications and variances. The embodiments described with reference to the attached figures are presented only to demonstrate certain examples of the disclosure. Other elements, steps, methods and techniques that are insubstantially different from those described above and/or in the appended claims are also intended to be within the scope of the disclosure. Further, any of the features described with respect to one embodiment, may be incorporated into any of the other embodiments described herein.

What is claimed:

1. A speaker mounting assembly comprising:

a top mount having an opening configured for receiving there through at least a portion of a speaker;

a speaker platform for resting the at least the portion of the speaker thereon; and a bottom mount configured for connecting to the top mount with the speaker platform, said speaker platform positioned between the top mount and the bottom mount and in proximity to a location where the top mount is connected to the bottom mount.

2. The speaker mounting assembly of claim 1, wherein the bottom mount has a wall extending from a base, where the wall includes a plurality of threads on an outer surface thereof.

3. The speaker mounting assembly of claim 2, wherein the top mount has a wall extending from a top surface, where the wall includes a plurality of threads on an inner surface thereof.

4. The speaker mounting assembly of claim 3, wherein the walls of both the top and bottom mounts are circular.

5. The speaker mounting assembly of claim 3, wherein the wall of the top mount has a diameter greater than a diameter of the wall of the bottom mount.

6. The speaker mounting assembly of claim 3, wherein the plurality of threads of the wall of the top mount and the plurality of threads of the wall of the bottom mount threadably engage each other for connecting the top mount and the bottom mount.

7. The speaker mounting assembly of claim 2, wherein an inner surface of the wall of the bottom mount includes a lip, a surface of said lip being co-planar with a top surface of a speaker platform support structure extending from the bottom mount.

8. The speaker mounting assembly of claim 1, wherein the top mount and the bottom mount are operatively coupled to each other.

9. The speaker mounting assembly of claim 1, wherein the top mount includes a plurality of grooves along a surface thereof.

10. The speaker mounting assembly of claim 1, further comprising:

a speaker platform support structure positioned between the bottom mount and the speaker platform.

11. The speaker mounting assembly of claim 1, further comprising a speaker platform support structure extending from a central portion of the bottom mount.

12. The speaker mounting assembly of claim 1, wherein a surface of the bottom mount is provided with an adhesive for mounting the speaker mounting assembly to a surface.

13. The speaker mounting assembly of claim 1, wherein the opening of the top mount has a keyhole shape for receiving a suction cup of the speaker.

14. A speaker mounting assembly kit comprising:

a speaker;

a top mount having an opening configured for receiving there through at least a portion of the speaker;

a speaker platform for resting the at least the portion of the speaker thereon; and a bottom mount configured for connecting to the top mount with the speaker platform, said speaker platform positioned between the top mount and the bottom mount and in proximity to a location where the top mount is connected to the bottom mount.

15. The speaker mounting assembly kit of claim 14, wherein the bottom mount has a wall extending from a base, where the wall includes a plurality of threads on an outer surface thereof.

16. The speaker mounting assembly kit of claim 15, wherein the top mount has a wall extending from a top surface, where the wall includes a plurality of threads on an inner surface thereof.

17. The speaker mounting assembly kit of claim 16, wherein the plurality of threads of the wall of the top mount and the plurality of threads of the wall of the bottom mount threadably engage each other for connecting the top mount and the bottom mount.

18. The speaker mounting assembly kit of claim 14, further comprising a speaker platform support structure extending from a central portion of the bottom mount.

19. The speaker mounting assembly kit of claim 15, wherein an inner surface of the wall of the bottom mount includes a lip, a surface of said lip being co-planar with atop surface of a speaker platform support structure extending from the bottom mount.

20. The speaker mounting assembly kit of claim 14, wherein the opening of the top mount has a keyhole shape for receiving a suction cup of the speaker.

* * * * *